United States Patent [19]

Harada et al.

[11] Patent Number: 4,917,060

[45] Date of Patent: Apr. 17, 1990

[54] IGNITION DEVICE FOR STARTING AN INTERNAL COMBUSTION ENGINE

[75] Inventors: Ryuzo Harada, Yokohama; Tadashige Kondo, Tokyo, both of Japan

[73] Assignee: Kioritz Corporation, Mitaka, Japan

[21] Appl. No.: 253,905

[22] Filed: Oct. 6, 1988

[30] Foreign Application Priority Data

Oct. 12, 1987 [JP] Japan ..... 62-256771

[51] Int. Cl.[4] ..... F02P 3/12; F02P 15/12

[52] U.S. Cl. ..... 123/179 BG; 123/641; 123/642

[58] Field of Search ..... 123/179 BG, 184, 642, 123/641, 620, 616

[56] References Cited

U.S. PATENT DOCUMENTS 2,954,506 9/1960 Harkness ..... 315/55
3,208,443 9/1965 Hurwitz ..... 123/616

FOREIGN PATENT DOCUMENTS 59-229058 12/1984 Japan ..... 123/642
712803 7/1954 United Kingdom .

*Primary Examiner*—Andrew M. Dolinar
*Attorney, Agent, or Firm*—Browdy and Neimark

[57] ABSTRACT

An ignition device for starting an internal combustion engine surely, having a starting member arranged on a rotor of a manual starter or a self-starter motor, the starting member being engaged with an actuating member of a piezoelectric element, an output terminal of which is electrically connected to a magneto ignition system.

4 Claims, 2 Drawing Sheets

IGNITION DEVICE FOR STARTING AN INTERNAL COMBUSTION ENGINE

BACKGROUND OF THE INVENTION

This invention is related to an ignition device for starting an internal combustion engine surely.

A conventionally used ignition device for an internal combustion engine is equipped with a magneto and an ignition coil and is actuated by the drive rotation of a recoil or a electric motor starter. Such a conventional ignition device has a disadvantage in that it is often incapable of starting the engine properly because only a low voltage is generated at relatively low rotation speed of the engine crank shaft.

SUMMARY OF THE INVENTION

It is accordingly an object of this invention to overcome the above problem in the conventional ignition device and to provide a simple and convenient ignition device for starting an internal combustion engine surely.

In accordance with this invention, there is provided an ignition device for starting an internal combustion engine surely having a starting member arranged on a rotor of a manual starter or a self-starter motor, said starting member being engaged with an actuating member of a piezoelectric element, an output terminal of said piezoelectric element being electrically connected to a magneto ignition system.

At the time of starting the engine, the starting member actuates the actuating member of the piezoelectric element, thereby causing the piezoelectric element to generate a voltage. The voltage thus generated is transmitted to the magneto ignition system where it is superimposed on the voltage generated by the magneto ignition system, resulting in a higher voltage which is transmitted to a spark plug of the engine.

As described above, the ignition device in accordance with this invention includes a starting member arranged on a rotor of a manual starter or a self-starter motor, said starting member being engaged with an actuating member of a piezoelectric element, an output terminal of said piezoelectric element being electrically connected to a magneto ignition system, said starting member actuating at start-up said actuating member of the piezoelectric element, thereby causing the piezoelectric element to generate a voltage which is transmitted to the magneto ignition system where it is superimposed on the voltage generated by the magneto ignition system, resulting in a higher voltage which is transmitted to the spark plug of the engine. This construction allows a sufficiently high voltage to be applied to the spark plug of the engine, thereby enabling the engine to be easily and positively started.

DESCRIPTION OF THE PREFERRED EMBODIMENTS

An embodiment of this invention will now be described with reference to the attached drawings.

Figure 1:
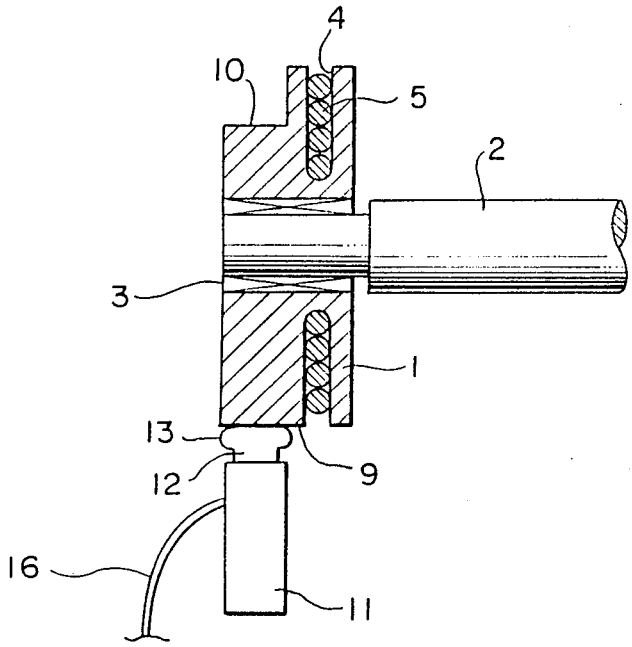
FIG. 1 is a side view showing the essential parts of an ignition device in accordance with this invention.
Figure 2:
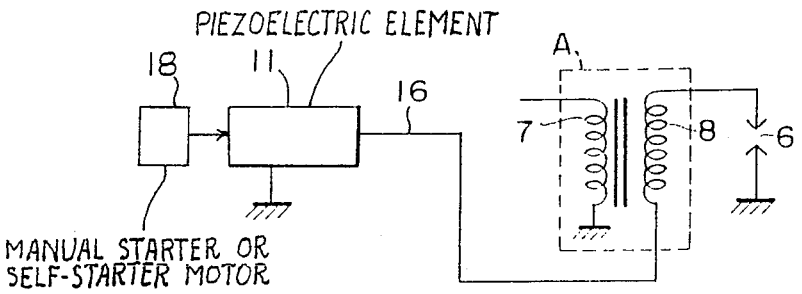
FIG. 2 is a diagram showing an electric circuit for use in the embodiment of FIG. 1.

FIG. 1 illustrates the present invention as applied to an internal combustion engine having a manual recoil starter. This starter includes a drum 1 rotatably provided in the starter body (not shown). This drum 1 is coaxially connected to the end portion of an engine crankshaft 2 through the intermediary of a one-way clutch 3. When the drum 1 rotates in the drive direction of the crankshaft 2 so as to move relative to this shaft, the one-way clutch 3 drives the crank shaft 2. When, on the other hand, the drum 1 moves relatively in the anti-drive direction of the crankshaft 2, the one-way clutch 3 cuts off the torque transmission between the drum 1 and the crank shaft 2, allowing them to rotate independently. Said drum 1 is equipped with a relatively deep circumferential groove 4. A starter rope 5 is wound in this circumferential groove 4. The inner end of this starter rope 5 is secured to the drum 1 at the bottom of said circumferential groove 4. The outer end of the starter rope 5 extends outwardly and is equipped with an appropriate grip (not shown) so that the operator may grasp it. Further, said drum 1 is equipped with a spiral spring device (not shown) adapted to bias it in the direction opposite to that of the drive rotation of the crankshaft 2. The resilient force of this spiral spring device serves to retain the starter rope 5 in the circumferential groove 4 in which it is wound. The ignition device includes a magnet rotor (not shown) provided in such a manner as to be rotatable with the crankshaft 2, and a magneto coil (not shown) provided in the body of the device and adapted to generate a voltage in cooperation with the magnet rotor, the voltage generated at the magnet coil being applied to a spark plug 6 (FIG. 2). An electric circuit of this ignition device encircled by chain line A in the drawing represents a normally employed circuit configuration. The voltage intermittently imparted to a primary ignition coil 7 by the magneto through a contact breaker (not shown) generates a high voltage in a secondary ignition coil 8, which high voltage is applied to the spark plug 6 of the internal combustion engine. Instead of this electric circuit, a normally used CDI circuit which is encircled by chain line B in FIG. 3 may be employed to apply the high voltage to the spark plug. 6.

When at the time of engine starting the operator seizes the grip at the outer end of the starter rope 5 of the recoil starter and pulls it to rotate the drum 1, the crankshaft 2 of the internal combustion engine is rotated through the one-way clutch 3. This causes the magnet rotor of the ignition system to rotate, thereby applying a high voltage to the spark plug 6 as described above so as to start the internal combustion engine. When released, the starter rope 5 is wound up again at the bottom of the circumferential groove 4 of the drum 1 and returned to its position in the groove 4 due to the action of the spiral spring device. Once the engine has been started, the drum 1 of the recoil starter is retained in the original position without being subjected to the torque of the crank shaft 2 because of the action of one-way clutch 3.

So far, the starter and the ignition device described are not different from those conventionally used. However, in the embodiment of this invention shown in FIG. 1, a circumferential round cam 9 serving as the starting member is formed on the outer peripheral surface of the drum 1. This cam 9 is formed radially off-center to form an eccentric section 10 on the drum 1. Further, the recoil starter has a piezoelectric element 11 in its body section. A plunger 12 which serves as the actuating member of this piezoelectric element 11 is outwardly biased in such a manner that the outer end 13 thereof abuts against the cam 9 of the drum 1. An output terminal 16 of the piezoelectric element 11 is connected in series to the secondary ignition coil 8 of the ignition circuit of FIG. 2.

With the above construction, operation of the recoil starter described above not only causes a high voltage to be generated in the secondary coil 8 of the ignition coil due to the magneto operation described above, but also results in a reciprocating motion of the plunger 12 which is brought about by the rotation of the drum 1 since the eccentric section 10 of the rotating cam 9 displaces the plunger 12 outwardly, and this causes the piezoelectric element 11 to generate a high voltage. This high voltage from the piezoelectric element 11 is applied to the secondary coil 8 of the ignition circuit, where it is superimposed on the high voltage generated at the secondary coil due to the operation of the magneto. The voltage which has thus become still higher is applied to the spark plug 6, thereby allowing the fuel in the engine cylinder to be ignited more positively. Further, the piezoelectric element 11 can ensure a long, trouble-free working life.

Figure 3:
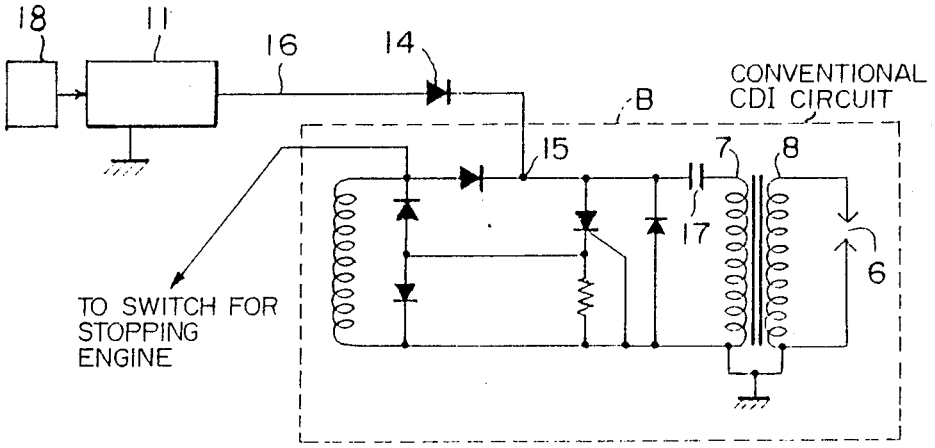
FIG. 3 is a diagram showing another electric circuit for use in the embodiment of FIG. 1.

When using a normal CDI circuit such as that encircled by the chain line B in FIG. 3, the output terminal 16 of the piezoelectric element 11 is connected to a point 15 of the CDI circuit through a diode 14, and the voltage generated at the piezoelectric element 11 is superimposed on the voltage which is due to the magneto operation and with which a capacitor 17 is charged. The still higher voltage thus obtained is applied to the spark plug 6, thereby ensuring more positive ignition of the fuel in the engine cylinder.

Further, the construction of the starter shown in FIG. 1 may be modified such that the cam 9 and the drum 1 are formed separately and so that they are linked with each other by a mechanism similar to the one-way clutch 3. The drum 1 will then only transmit the torque to the cam member to drive it when the starter rope 5 is being pulled out. The piezoelectric element 11 is then operated and causes the plunger 12 to be displaced. When, on the other hand, the drum 1 is being driven in the opposite direction, its torque is not transmitted to the cam member. This avoids any unnecessary operation of the piezoelectric element 11.

When using a self-starter motor 18, FIGS. 2 and 3, instead of the recoil starter of FIG. 1, a similar cam may be formed on the outer peripheral surface of the rotor of the motor, said cam abutting against the plunger 12 of the piezoelectric element 11 so that the piezoelectric element 11 may generate electricity.

It is naturally understood that the starting member of this invention is not to be restricted to the cam member illustrated in the above-described embodiments.

What is claimed is:

1. An ignition device for starting an internal combustion engine comprising a starting member arranged on a rotor of a manual starter or a self-starter motor, said starting member being engaged with an actuating member of a piezoelectric element, and an output terminal of said piezoelectric element being electrically connected to a magneto ignition system.

2. An ignition device as claimed in claim 1, wherein said starting member is an eccentric cam.

3. An ignition device as claimed in claim 1, wherein the output terminal of said piezoelectric element is connected in series to the secondary coil of said magneto ignition system.

4. An ignition device as claimed in claim 1, wherein the output terminal of said piezoelectric element is connected to a CDI circuit through a diode.

* * * * *